US005791491A

United States Patent [19]

Singleton, Jr.

[11] Patent Number: 5,791,491

[45] Date of Patent: Aug. 11, 1998

[54] APPARATUS AND METHOD FOR EXTRACTING IMPURITIES FROM A PULPOUS SLURRY

[76] Inventor: Robert Singleton, Jr., 1960 Paddock Ct., Lawrenceville, Ga. 30243

[21] Appl. No.: 528,776

[22] Filed: Sep. 15, 1995

Related U.S. Application Data

[63] Continuation-in-part of Ser. No. 257,006, Jun. 8, 1994, Pat. No. 5,492,224.

[51] Int. Cl.[6] ..... B04C 3/04

[52] U.S. Cl. ..... 209/210; 209/271; 209/725; 210/294; 210/787

[58] Field of Search ..... 209/2, 12.1, 17, 209/208, 210, 271, 459, 724, 725, 733, 734; 210/294, 512.1, 787, 788; 162/55

[56] References Cited

U.S. PATENT DOCUMENTS

| | | | |
|---|---|---|---|
| 3,452,862 | 7/1969 | Amadon et al. | 209/2 |
| 3,662,885 | 5/1972 | Dorph | 209/161 |
| 3,779,381 | 12/1973 | Armstrong | 209/271 |
| 4,280,902 | 7/1981 | Jacobson et al. | 209/211 |
| 4,316,768 | 2/1982 | Goddard | 162/336 |
| 4,361,490 | 11/1982 | Saget | 209/210 X |
| 4,952,314 | 8/1990 | Henricson et al. | 210/404 |
| 4,981,219 | 1/1991 | Burnell et al. | 209/210 X |
| 5,009,796 | 4/1991 | Petrik et al. | 210/787 |
| 5,114,568 | 5/1992 | Brinsmead et al. | 209/210 X |
| 5,124,049 | 6/1992 | Maness | 210/715 |
| 5,186,823 | 2/1993 | Robinson | 210/197 |

FOREIGN PATENT DOCUMENTS

| | | | |
|---|---|---|---|
| 1338882 | 9/1987 | U.S.S.R. | 209/271 |
| 1479103 | 5/1989 | U.S.S.R. | 209/733 |

*Primary Examiner*—William E. Terrell
*Assistant Examiner*—Tuan N. Nguyen
*Attorney, Agent, or Firm*—Kennedy, Davis & Kennedy

[57] ABSTRACT

An apparatus (110) for extracting impurities from a pulpous slurry. The apparatus has a housing (111) and an auxiliary chamber (113). The housing has a separation chamber (127) having stack of disks (159) spaced from each other so as to form channels (172) therebetween. The disks are mounted to a drive shaft (160) which is rotatably driven by a motor (161). The action of the rotating disks cause impurities to be projected to the outermost portion of the separation chamber while the desired pulpous fibers pass between through the channel to an accept tube (193) for collection.

22 Claims, 6 Drawing Sheets

APPARATUS AND METHOD FOR EXTRACTING IMPURITIES FROM A PULPOUS SLURRY

REFERENCE TO RELATED APPLICATION

This is a continuation-in-part of application Ser. No. 257,006 filed Jun. 8, 1994, now U.S. Pat. No. 5,492,224.

TECHNICAL FIELD

This invention relates to apparatuses and a method for extracting impurities from a pulpous slurry.

BACKGROUND OF THE INVENTION

Generally, paper is manufactured by pouring a pulpous slurry over a fine screen so that liquids within the slurry are drained through the screen thus leaving a matt of pulp fibers thereon. The pulp matt is then pressed to squeeze out any remaining liquid and compress the pulp fibers closer together to form a firm sheet. The sheet is then treated to produce a smooth glossy surface.

To obtain the pulpous slurry trees are harvested, debarked and shipped as logs to a grinding facility. The logs are ground between grindstones to dissociate the wood fibers from each other. Through this process however impurities are collected with the pulp, such as teeth from the saws that cut the trees, metal flakes from the debarker, bits of bark, sand, dirt, plastic and other foreign particles from machinery used to process the logs. These impurities must be removed from the pulpous slurry prior to the slurry being passed through the fine screen, otherwise, they would be embedded within the finished paper making it unacceptable for use. As an alternative to grinding, the logs may be chemically broken down into pulp fibers. Also, as an alternative to obtaining pulp from harvested trees, finished paper may be recycled by breaking it down into pulp again. Nevertheless, with these alternative methods, impurities must still be removed from the pulp fibers.

It is well known that impurities are extracted from the pulpous slurry by screens, hydrocyclones or a combination of screens and hydrocyclones. Because these impurities are usually small, their removal by screening alone is not very effective. Therefore, hydrocyclones are often used to extract impurities. Hydrocyclones may be used in series, commonly referred to as a cascade, to increase the percentage of impurities removed while attempting to prevent the waste of acceptable pulp fibers inadvertently expelled with the impurities through their recapture by another hydrocyclone coupled downstream.

Hydrocyclones typically have a conical housing with a reject tip on its lower end, an inlet pipe mounted at an upper end of the conical housing and an accept pipe mounted centrally within the housing. The inlet pipe is mounted generally tangential to the conical housing so that the slurry entering the housing is forced to rotate about the accept pipe towards the reject tip. The rapid rotation of the slurry causes the lighter particles to accumulate at the center with the heavier particles accumulating about the periphery due to the centrifugal forces acting on the particles. The majority of the pulp fibers is expelled from the hydrocyclone through the accept pipe. The majority of the heavy impurities sink to the bottom of the conical housing and are expelled through the reject tip. Because many impurities have similar densities to that of the acceptable pulp fibers, they often must be passed through hydrocyclones several times for their removal.

Another problem which commonly occurs with hydrocyclones is that large, solid objects such as rocks often enter the hydrocyclone which eventually block or clog the reject tip. Also, impurities which are embedded within large clumps of pulp fibers are not effectively extracted from the clumps of pulp.

Accordingly, it is seen that a need remains for a more efficient apparatus for extracting impurities from a pulpous slurry. It is to the provision of such therefore that the present invention is primarily directed.

SUMMARY OF THE INVENTION

In a preferred form of the invention an apparatus for extracting impurities in excess of a selected size from pulp fibers of a pulpous slurry comprises a separation chamber having walls, first conduit means for introducing a stream of pulpous slurry into the separation chamber, and second conduit means for conveying pulp fibers the separation chamber having an entrance positioned within the separation chamber. The apparatus also has means for drawing the pulpous slurry towards the entrance and means for inhibiting impurities of a size larger than the selected size from entering the entrance. The inhibiting means includes two rotatably driven disks mounted adjacent the entrance which are spaced apart from each other a distance less than the selected size with one of the disk having an entrance therethrough adjacent the second conduit entrance. The apparatus also has means for rotating the disks and third conduit means for extracting pulpous slurry with impurities of a size larger than the selected size collect from the chamber. With this construction, rotation of the disks causes impurities larger than the selected size to be projected outward upon contact with the rotating disks while permitting pulp fibers smaller that the selected size to be drawn into the second conduit means thereby separating the impurities from the pulpous fibers.

DETAILED DESCRIPTION

Figure 1:
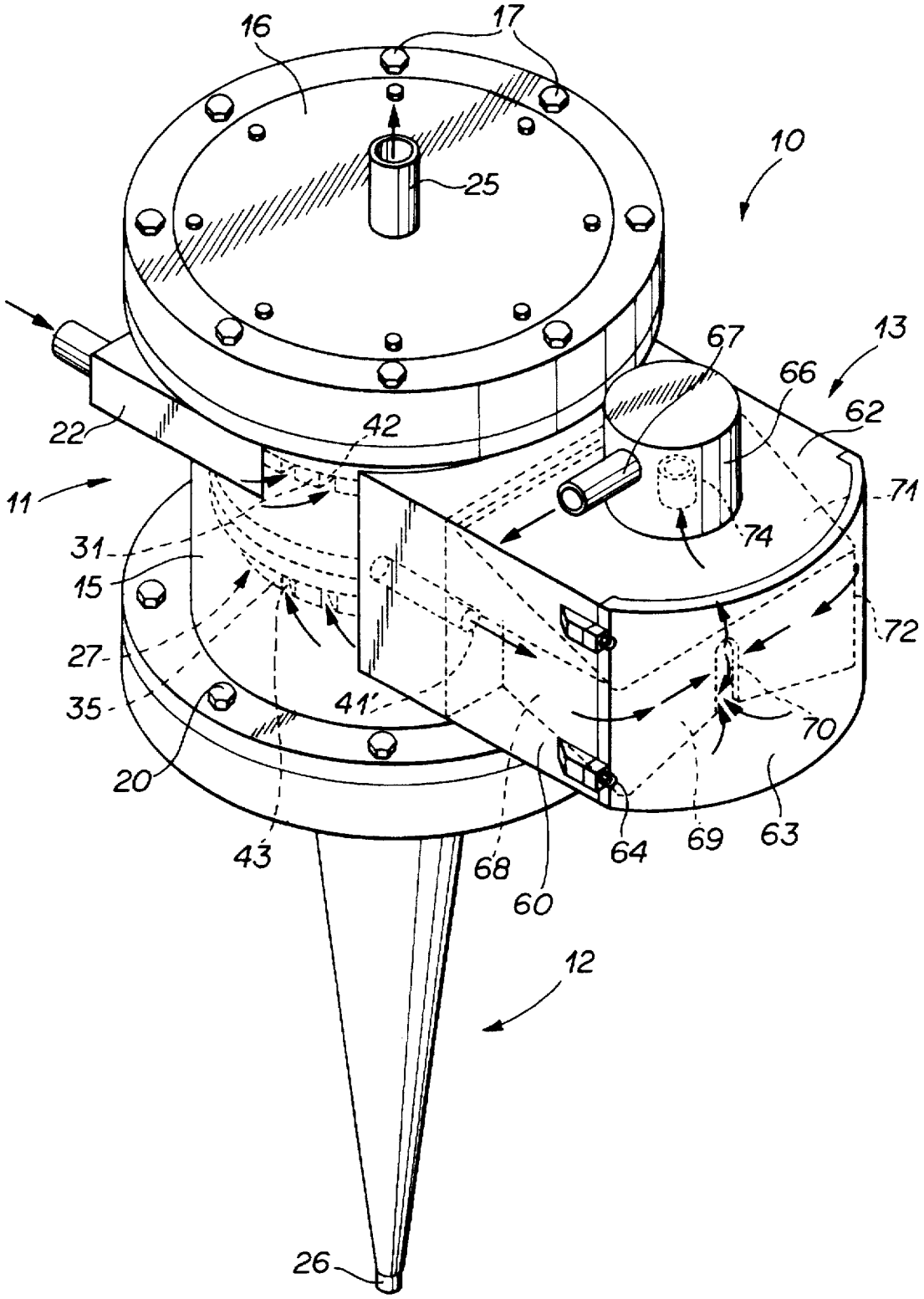
FIG. 1 is a perspective view of an apparatus for extracting impurities from a pulpous slurry embodying principles of the invention in a preferred form.

With reference to FIGS. 1–6, there is shown an apparatus 10 for extracting impurities from a pulpous slurry. The apparatus 10 has a generally cylindrical upper housing 11, a conical lower housing 12 depending from the upper housing 11, and an auxiliary chamber 13 mounted to the upper housing.

The upper housing 11 has a tubular side wall 15, an annular upper cap 16 mounted to the top of the side wall 15 and secured thereto by bolts 17, and an annular bottom cap 19 mounted to the bottom of the side wall 15 and secured thereto by bolts 20. The upper housing 11 also has an upper intake manifold 22 and a lower intake manifold 23. An accept tube 25 is positioned within the upper housing 11 along the longitudinal axis of the cylindrical side wall 15 so as to extend through the upper cap 16 and depend axially within the lower housing 12. The lower housing 12 has a reject tip 26 forming the lower end. An unshown collection tube may be mounted to the reject tip.

Figure 3:
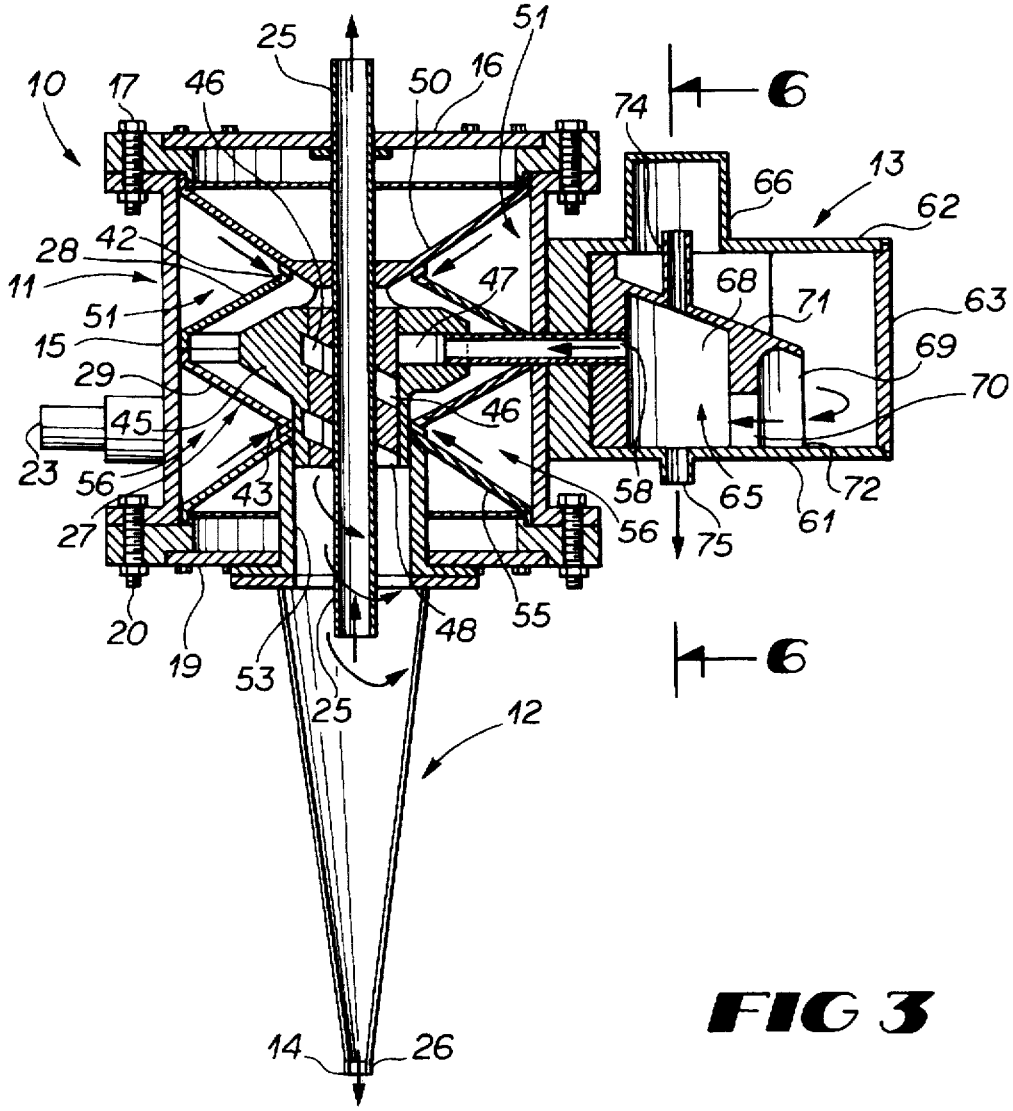
FIG. 3 is a cross-sectional view of the apparatus of FIG. 1 taken along plane 3—3 of FIG. 2.
Figure 5:
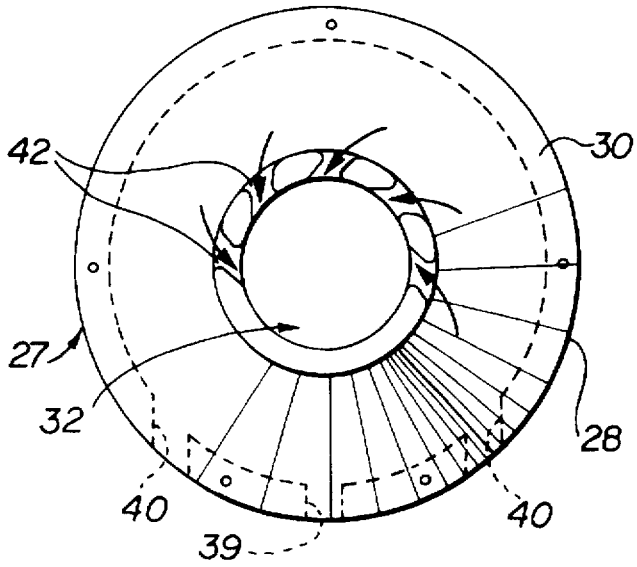
FIG. 5 is a top view of the separation chamber of the apparatus of FIG. 1.
Figure 4:
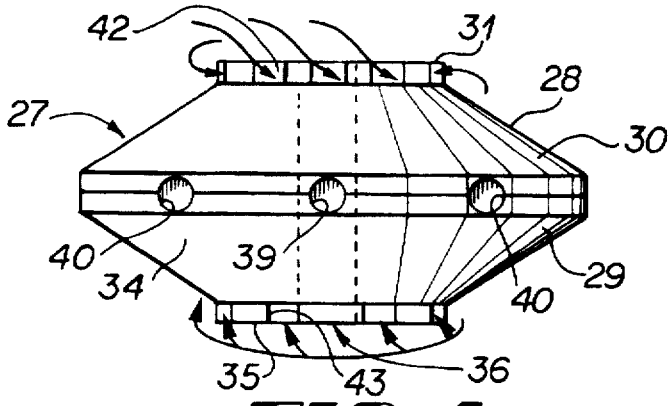
FIG. 4 is a front elevational view of a separation chamber of the apparatus of FIG. 1.
Figure 6:
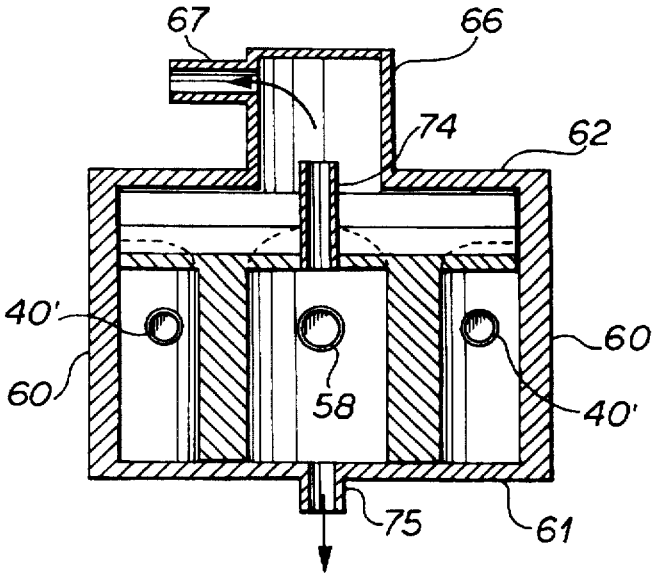
FIG. 6 is a cross-sectional view of an auxiliary chamber of the apparatus of FIG. 1 taken along plane 6—6 of FIG. 3.

A separation chamber 27 is mounted axially within the upper housing and about accept tube 25. As best shown in FIGS. 3 and 4, the separation chamber 27 is comprised of an upper shell 28 and a lower shell 29 sized and shaped to conform with the upper shell 28 about their periphery. The upper shell 28 has a truncated conical portion 30 and an annular, entry portion 31 having a central opening 32 therethrough. Likewise, the lower shell 29 has a truncated conical portion 34 and an annular, entry portion 35 having a central opening 36 therethrough. The upper and lower shells each have three semi-circular channels which form a circular, central, inlet port 39 and two circular, outer, outlet ports 40 when the shells are positioned together. As best shown in FIG. 5, the upper shell entry portion 31 has five entry channels 42 extending therethrough at an oblique angle with respect to a radial extending from the axis of the upper housing 11. Similarly, the lower shell entry portion 35 has five entry channels 43 extending therethrough at an oblique angle with respect to a radial extending from the axis of the upper housing 11. A central manifold 45 is mounted within the upper and lower shells 28 and 29 and about the accept tube 25. The central manifold 45 has a generally helical passage 46 therethrough commencing at inlet 47 and terminating at outlet 48.

A generally frustum-shaped spacer 50 is mounted within the upper housing 11 with its narrow end extending through the upper shell central opening 32 into abutment with the upper shell so as to form an annular, upper channel 51 therebetween. The upper channel 51 is in fluid communication with the interior of the separation chamber 27 through entry channels 42. A generally cylindrical tube 53 extends from a lower portion of the central manifold 45 to the conical lower housing 12. Another generally frustum-shaped spacer 55 is mounted within the upper housing 11 in abutment with the lower shell 29 so as to form an annular, lower channel 56 therebetween. The lower channel 56 is in fluid communication with the interior of the separation chamber 27 through entry channels 43. An entry tube 58 coupled to the inlet 47 of helical passage 46 extends through the upper housing 11 and central inlet port 39.

The auxiliary chamber 13 has side walls 60, a bottom wall 61, a top wall 62 and an end wall 63 removably mounted to the side walls 60 by bolts 64. The outlet ports 40 of the separation chamber continue through the auxiliary chamber as outlet ports 40'. The auxiliary chamber 13 has an inner chamber 65, a cylindrical waste chamber 66 extending from top wall 62 and a waste tube 67 extending from the waste chamber 66. The inner chamber 65 is defined by inner chamber side walls 68, inner chamber end walls 69 having a central passage 70 therethrough, an inner chamber to wall 71 and a portion of the auxiliary chamber bottom wall 61. The intersection of the inner chamber side walls 68 with the inner chamber end walls 69 form corners 72. A top outlet tube 74 extends from the inner chamber top wall 71 into the waste chamber 66. A bottom reject tip 75 extends from the bottom wall 61 of the auxiliary chamber and inner chamber. The outlet tube 67 may be coupled to an unshown collection tube. The inner chamber 13 is in fluid communication with the central manifold 45 through entry tube 58.

In use, a pulpous slurry flow is bifurcated into two streams prior to entering the apparatus 10. The flow rate of the slurry entering the apparatus is preferably between 115 to 150 gallons per minute. One stream is passed through the upper intake manifold 22 into the upper channel 51. The other stream is passed through the lower intake manifold 23 into the lower channel 56. The stream within the upper channel 51 is forced by fluid pressure through the entry channels 42 of entry portion 31 into an upper, interior portion of the separation chamber 27. The oblique angle of the entry channels 42 causes the stream to circulate within the chamber in a counterclockwise direction about the accept tube and central manifold. Simultaneously, the stream within the lower channel 56 is likewise forced through the entry channel 43 of entry portion 35 into the lower, interior portion of the separation chamber 27. Here the oblique angle of the entry channels 43 causes the stream to circulate within the chamber 27 in a clockwise direction about the accept tube and central manifold. The rotary flow of the streams causes clumps of pulp to break up thus freeing any impurities bound therein. The rotation of the streams also causes impurities which are heavier than pulp fibers, i.e. having a specific gravity greater than that of pulp, to move outward and gather adjacent the periphery of the upper and lower shells 28 and 29. The opposite directions of the stream flows causes a generally stagnant zone to occur between the two streams in a zone generally located about a horizontal plane at the junction of the two shells. The term "stagnant zone" is meant to describe an area wherein the pulp is not rotationally moving. By having the entry channels 42 and 43 positioned about only one half of the entry portions 31 and 35, respectively, the flow rate of the slurry entering the separation chamber is maintained at a low enough level to eliminate or at least reduce the possibility of clogging the channels.

As the slurry streams enter the separation chamber a proportionate volume of slurry is forced from the chamber through outlet ports 40. The stream which is forced through ports 40 is comprised of a combination of heavy impurities, light impurities and pulp fibers. The heavy impurities tend to move through the ports 40 along the port walls while the pulp and light impurities move through the center of the ports. The pulp and light impurities also move through the ports at a higher rate of speed than that of the heavy impurities. These flow dynamics maintain significant separation of the heavy impurities from the pulp fibers as they travel through the common ports.

Figure 2:
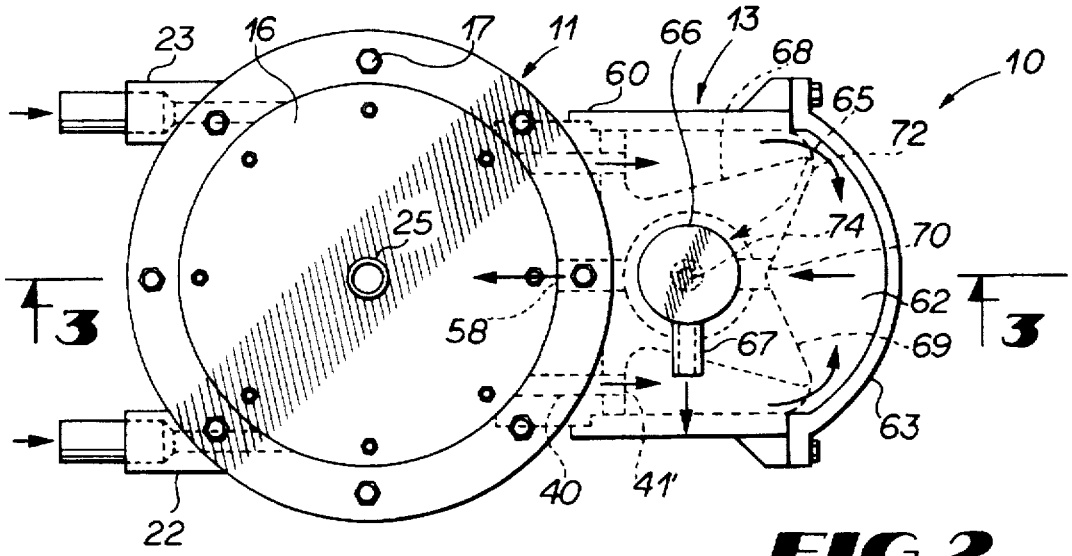
FIG. 2 is a top view of the apparatus of FIG. 1.

The slurries are passed from the outlet ports 40' into the interior of the auxiliary chamber 13 where they enter the auxiliary chamber between the auxiliary chamber side walls 60 and the inner chamber side walls 68, as indicated by the arrows in FIGS. 1 and 2. As the slurries flow about corners 72 their flow rates immediately decrease as a result of the enlarging space of travel between the auxiliary chamber end wall 63 and the inner chamber end wall 69. This decrease in the flow rate allows the light and heavy impurities to separate further from the pulp fibers due to the differences in their specific weight. Hence, light impurities, those having a specific weight less than that of pulp such as plastics and inks, and the majority of air within the slurry, flow upward into waste chamber 66. These light impurities are expelled from the waste chamber through waste tube 67. Heavy impurities, those having a specific weight greater than that of the pulp such as metal particles, sand and dirt, sink to the bottom of the auxiliary chamber wherein they flow through passage 70 into inner chamber 65. The pulp fibers also flow through passage 70 into inner chamber 65.

Once within the inner chamber 65, any remaining light impurities and air flow toward the top of the inner chamber and into the waste chamber 66 through top outlet tube 74. The heavy impurities are expelled from the inner chamber and into the waste chamber 66 through top outlet tube 74. The heavy impurities are expelled from the inner chamber through bottom reject tip 75. The pulp and any remaining impurities are conveyed from the inner chamber through entry tube 58 into the helical passage 56 of central manifold 45. The helical passage 56 causes the slurry to rotate about accept tube 25 as it exits outlet 48, as indicated by the arrows in FIG. 3. Rotation of the slurry within the conical, lower housing 12 is generally that of a conventional hydrocyclone. Therefore, any heavy impurities sink to the bottom of the lower housing and are removed through reject tip 26. The pulp fibers are conveyed from the lower housing 12 through accept tube 25.

It should be understood that several apparatuses 10 may be used in a cascade series through the use of the unshown collection tubes so that any pulp which may also be expelled from the apparatus with the impurities through reject tips 26 and 75 and waste tube 67 may be recovered by another like apparatus coupled downstream. Also, two different pulpous slurries may be introduced into the apparatus through the intake manifolds 22 and 23 rather than a single, bifurcated slurry. This allows for a slurry of long pulp fibers to be combined with a slurry of short pulp fibers within the apparatus, as previously these would have to be brought together in a tank previous to separation. Similarly, a slurry of virgin pulp may be combined with a slurry of recycled pulp.

Solid objects which are drawn into the apparatus are collected within the upper channel 51 or lower channel 56. These objects may be removed and the apparatus cleaned by unthreading bolts 17 and 20, removing upper cap 16 and bottom cap 19, and removing cone-shaped spacers 50 and 55. The solid object may then be removed from the apparatus. Obviously, only one cap and spacer need be removed for quickly removing an object. If desired the separation chamber 27 may be cleaned further by removing the upper shell 28 and lower shell 29 from the upper housing 11. The auxiliary chamber 13 may be cleaned by unthreading bolts 64 and removing end wall 63.

Figure 7:
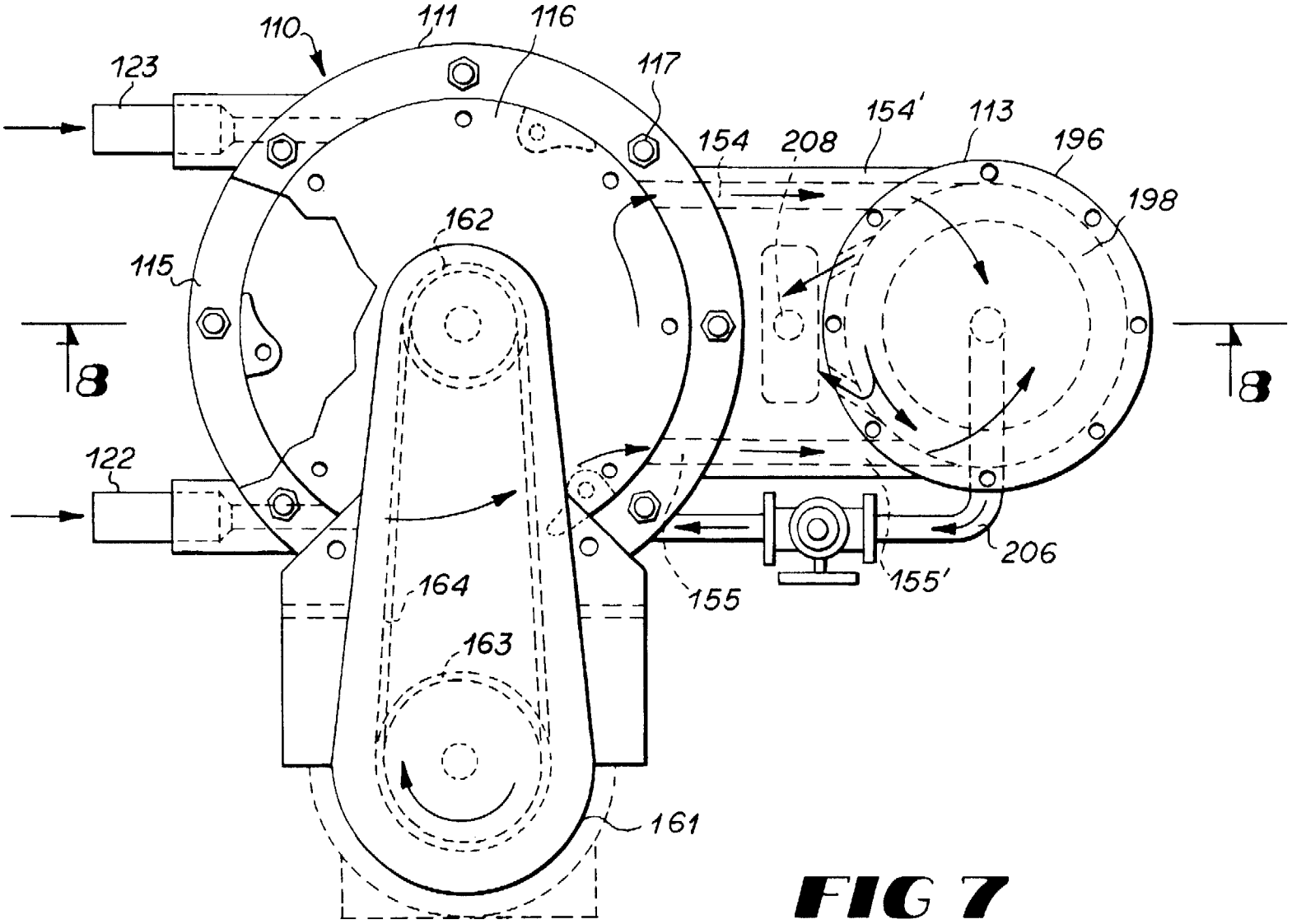
FIG. 7 is a top view of an apparatus for extracting impurities from a pulpous slurry embodying principles of the invention in another preferred form.
Figure 8:
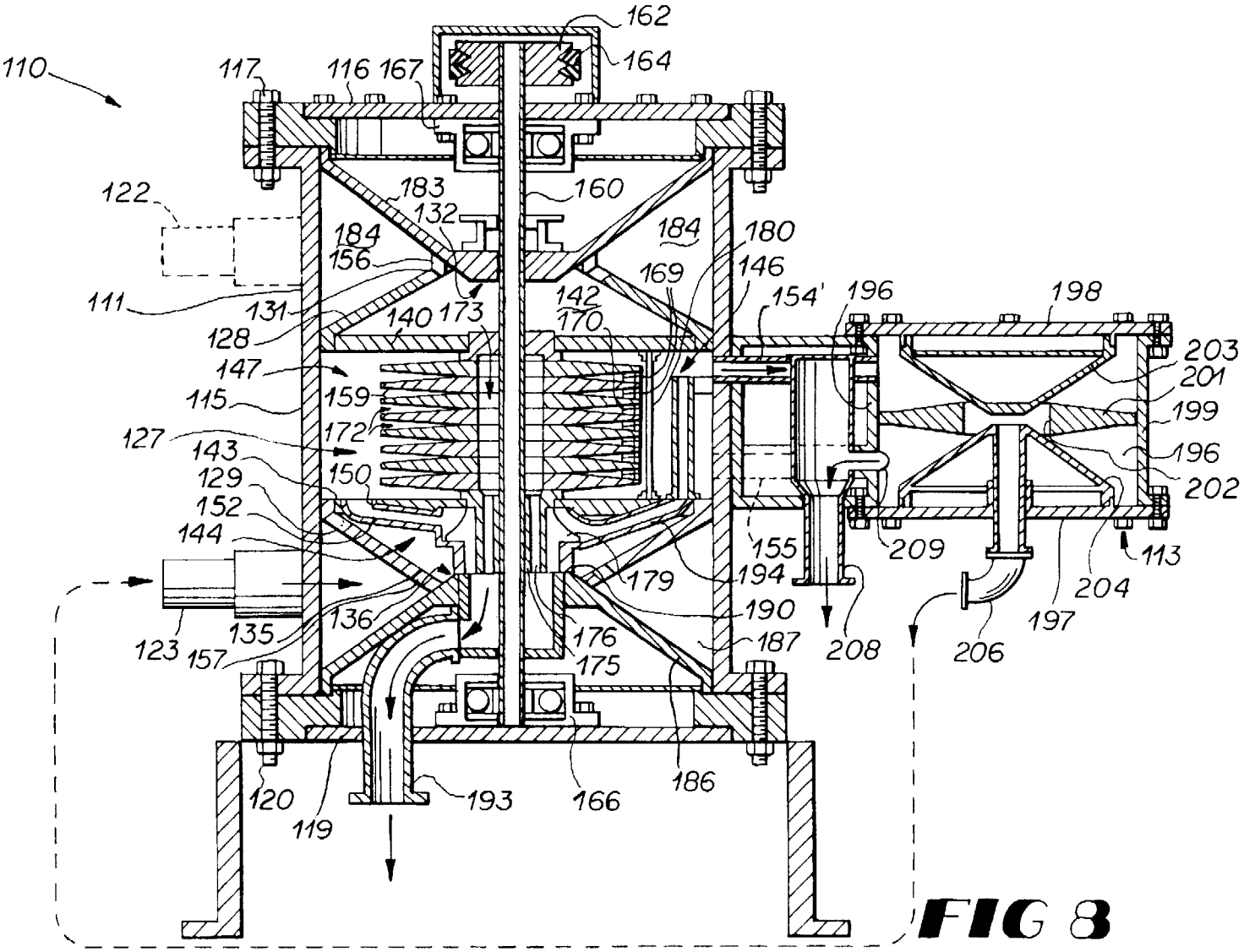
FIG. 8 is a cross-section view of the apparatus taken along plane 8—8 of FIG. 7.
Figure 10:
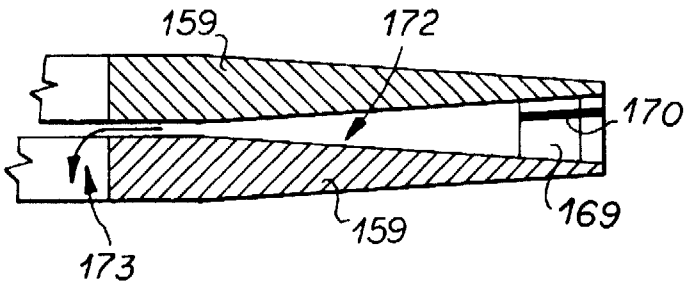
FIG. 10 is a detailed view of a portion of two disks, foil, and spacing shim of the apparatus of FIG. 7.
Figure 9:
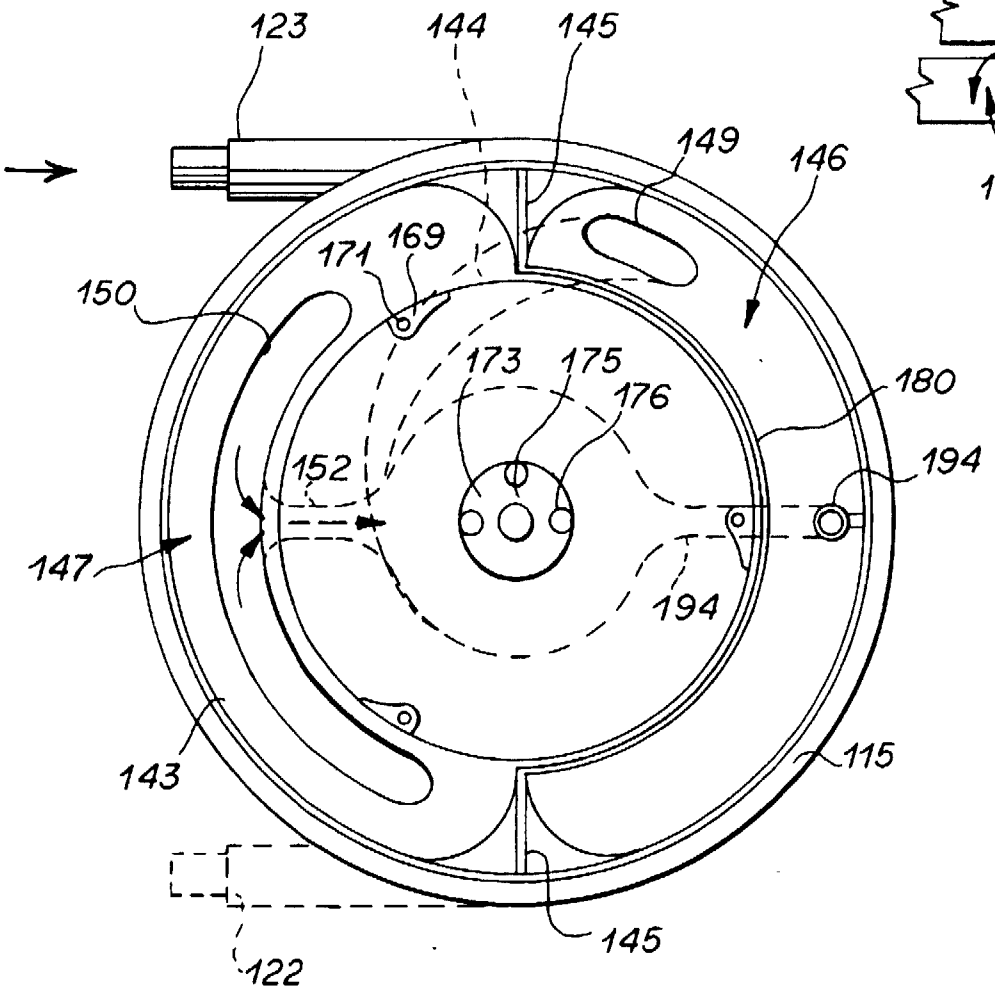
FIG. 9 is a cross-section view of the apparatus taken along plane 9—9 of FIG. 8.

With reference next to FIGS. 7–8, there is shown an apparatus 110 in an alternative embodiment for extracting impurities from a pulpous slurry. The apparatus 110 has a generally cylindrical housing 111 and an auxiliary chamber 113 mounted to the housing 111.

The housing 111 has a tubular side wall 115, an annular upper cap 116 mounted to the top of the side wall 115 and secured thereto by bolts 117, an annular bottom cap 119 mounted to the bottom of the side wall 115 and secured thereto by bolts 120. The housing 111 also has an upper intake manifold 122 and a lower intake manifold 123.

The housing has a separation chamber 127 positioned axially within the housing. As best shown in FIG. 8, the separation chamber 127 is comprised of a truncated conical upper shell 128 and a truncated conical lower shell 129. The upper shell 128 has an annular, entry portion 131 having a central opening 132 therethrough. Likewise, the lower shell 129 has an annular, entry portion 135 having a central opening 136 therethrough. An upper annular plate 140 having an entry port 141 therethrough is mounted to the bottom edge of the upper shell 128 so as to form an annular transition channel 142 therebetween. A lower annular plate 143 is mounted to the top of the lower shell 129 to form an arcuate lower transition channel 144 therebetween. A pair of oppositely disposed divider walls 143 extend between the lower annular plate 143 and the upper annular plate 140 so as to form a semi-circular, first separation channel 146 and a semi-circular second separation channel 147. Lower annular plate 143 has an entry port 149 and an elongated, arcuate exit port 150 therethrough in fluid communication with the second separation channel 147 and which is coupled to a first conduit 152. Entry port 141 of the upper annular plate 140 and entry port 149 of the lower annular plate 143 are in fluid communication with the first separation channel 146. The side walls 115 have an upper outlet port 140 and a lower outlet port 141 in fluid communication with the first separation channel 146. Similarly to the embodiment described in FIGS. 1–6, here the upper shell entry portion 131 has five entry channels 156 extending therethrough at an oblique angle with respect to a radial extending from the axis of the housing 111. Similarly, the lower shell entry portion 135 again has five entry channels 157 extending therethrough at an oblique angle with respect to a radial extending from the axis of the housing 111.

A stack of five, axially aligned, generally annular, tapered disks 159 are mo[illegible] to a drive shaft 160 aligned along the longitudinal axi[illegible]ing through the housing. Drive shaft 160 is rotatably co[illegible]d to a motor 161 through a first pulley 162 mounted to the upper end of the drive shaft 160, a second pulley 163 mounted to the motor 161, and a pulley belt 164 extending between and about the first and second pulleys. The drive shaft 160 is also coupled at its bottom end to a first bearing 166 extending from the bottom cap 119 and to a second bearing 167 extending from the upper cap 116. An annular array of three foils 169 is mounted between each adjacent pair of disks 159. A spacing shim 170 is mounted to the top of each foil 169. The foils 169 and shims 170 are mounted to pins 171 extending through the disks. The disks 159 are configured and spaced from each other, by use of foils 169 and shims 170, so as to form an annular, inwardly tapered channels 172 between successive disks. Tapered channels 172 extend to a central channel 173 which extends through the center of the disks. Preferably the height of the channels adjacent the central channel 173 is between 0.0003 inch to 0.125 inch, dependant upon the size of the impurities desired to be extracted. A central manifold 175 is mounted to the lowermost disk. The central manifold 175 has three passages 176 extending therethrough. An impeller 179 is fixedly mounted to central manifold 175. A semi-circular screen 180 is mounted between the divider wall 145 closely adjacent the periphery of the disks.

A generally frustum-shaped upper spacer 183 is mounted within the housing 111 with its narrow end extending through the upper shell central opening 132 into abutment with the upper shell so as to form an annular, upper channel 184 therebetween. The upper channel 184 is in fluid communication with the upper transition channel 142 through entry channels 156. Another generally frustum-shaped lower spacer 186 is mounted within the housing 111 in abutment with the lower shell 129 so as to form an annular, lower channel 187 therebetween. The lower channel 187 is in fluid communication with the lower transition channel 144 through entry channels 157. A stepped-cylindrical tube 190 is mounted to the center of the lower annular plate 143 and partially about impeller 179. Cylindrical tube 190 is coupled to an accept tube 193 that extends through the housing. A second conduit 194 extends from the cylindrical tube 190 to the first separation channel 146.

The auxiliary chamber 113 has side walls 196, a bottom wall 197, a top wall 198 removably mounted to the side walls 196, and an end wall 199. The upper and lower outlet ports 154 and 155 of the separation chamber continue through the auxiliary chamber as outlet ports 154' and 155' respectively. The auxiliary chamber has an annular central plate 201 having a central passage 202 therethrough, a frustum-shaped, upper spacer 203 extending from the top wall 198 and a frustum-shaped, lower spacer 204 extending from the bottom wall 197. The narrow ends of the upper and lower spacers 203 and 204 extend into the annular central plate central passage 202. A return tube 206 extends from the narrow end of the lower spacer 204. The return tube 206 is coupled to the lower intake manifold 123, however, it should be understood that the return tube may be coupled to the upper intake manifold 122. The auxiliary chamber 113 also has a reject tube 208 coupled to two reject ports 209 extending through side wall 196.

In use, with the motor 161 rotating drive shaft 160 and the disks 159 mounted thereto, a pulpous slurry flow is bifurcated into two streams prior to entering the apparatus 110. The flow rate of the slurry entering the apparatus is preferably between 115 to 150 gallons per minute. One stream is passed through the upper, intake manifold 122 into the upper channel 184. The other stream is passed through the lower, intake manifold 123 into the lower channel 187. The stream within the upper channel 184 is forced by fluid pressure through the entry channels 156 of entry portion 131 into an upper, transition channel 142. The oblique angle of the entry channels 156 causes the stream to circulate within the chamber in a counterclockwise direction about drive shaft 160. The stream then passes through the entry port 141 of the upper annular plate 140 into an upper portion of the first separation channel 146 of separation chamber 127, with continued counterclockwise rotation. Simultaneously, the stream within the lower channel 187 is likewise forced through the entry channel 157 of entry portion 135 into the lower transition channel 144. Here the oblique angle of the entry channels 157 causes the stream to circulate within the lower transition channel 144 in a clockwise direction about the drive shaft. This stream then passes through the entry port 149 of the lower annular plate 143 into a lower portion of the first separation channel, with continued clockwise rotation. The rotary flow of the streams causes clumps of pulp to break-up thus freeing any impurities bound therein. The rotation of the streams also causes impurities which are heavier than pulp fibers, i.e. having a specific gravity greater than that of pulp, to move outward and gather adjacent the housing side walls 115. The opposite directions of the stream flows causes a generally stagnant zone to occur between the two streams in a zone generally located about a horizontal plate approximately midway between the upper and lower annular plates 140 and 143.

As the slurry streams pass from the first separation channel 146 to the second separation channel 147 large impurities are filtered therefrom by screen 180. The rotation of the disks 159 causes the foils 169 mounted thereto to draw the slurry towards the center of the disks. The pulpous fibers pass through the tapered channels 172 between the disks and into the central channel 173 passing through the center of the disks. These pulpous fibers then pass through the central manifold passages 176 and into the accept tube 193 where they are collected at a separate collection site. Impurities however larger than the channels 172 contact the rotating disks where they are projected outward by the movement of the disks toward the side wall 115 of the housing. These impurities drift downward and into the arcuate exit port 150 where they are then conveyed through the first conduit 152 and second conduit 194 into the first separation channel 146, through the force generated by impeller 179. The impurities are recycled to the first separation channel because desirous pulpous fibers are often expelled from the second separation channel 147 along with the impurities. Therefore, this portion of the slurry is recycled in an attempt to recapture these pulpous fibers. It should be understood that the principles of the counter-rotating streams apply equally to this embodiment.

The slurries are then passed from the upper and lower outlet ports 154 and 155 into the interior of the auxiliary chamber 113. The stream passing from the upper outlet port 154 circulates between the central plate 201 and the upper spacer 203 in a clockwise direction about the upper spacer 203. The stream passing from the lower outlet port 155 circulates between the central plate 201 and the lower spacer 204 in a counterclockwise direction about the lower spacer 204. Again, the pulpous fibers tend to collect toward the center of the streams, while the impurities collect along the sidewalls 196 of the auxiliary chamber 113. As such, the pulpous fibers pass between the central plate 201 and the upper and lower spacers 203 and 204 into the central passage 202, where they are then conveyed therefrom by return tube 206 to the lower intake manifold 123 for recapture. The impurities pass through reject ports 209 into reject tube 208 where they are expelled from the apparatus as waste.

It should be noted that the movement of the foils 169 past the screen aids in cleaning the screen by both drawing pulpous fibers through the screen and pushing impurities away from the screen through changes in fluid pressure about the foils. The spacing shims 170 are designed to be interchanged quickly with other spacing shims 170 of different heights so as to vary the distance between adjacent disks, thus varying the size of channels 172 between the disks and the size of the desired pulpous fibers captured therein. Again, apparatus 110 may be used in combination with a hydrocyclone and may be used in series with other like apparatuses. Also, the apparatus may be cleaned in the same manner as previously described.

It should also be understood that as an alternative to the return tube 206 being coupled to the lower intake manifold 123, the return tube 206 may be coupled directly to side wall 115 so as to convey the pulpous fibers back into the lower channel 187.

From the foregoing it is seen that an apparatus for extracting impurities from a pulpous slurry is now provided which overcomes problems associated with those of the prior art. It should be understood however, that the just described embodiment merely illustrates principles of the invention in its preferred form. Many modifications, additions and deletions may be made thereto without departure from the spirit and scope of the invention as set forth in the following claims.

I claim:

1. Apparatus for extracting impurities in excess of a selected size from pulp fibers of a pulpous slurry, comprising, a separation chamber having walls;

first conduit means for introducing a stream of pulpous slurry into said separation chamber;

second conduit means for conveying pulp fibers from said separation chamber, said second conduit means having an entrance positioned within said separation chamber;

means for drawing the pulpous slurry towards said entrance;

means for inhibiting impurities of a size larger than the selected size from entering said entrance, said inhibiting means comprising (a) two rotatably driven disks mounted adjacent said entrance spaced apart from each other a distance less than the selected size to form an entrance channel therebetween, and with at least one said disk having a conveyance channel extending between and in fluid communication with said entrance channel and said second conduit entrance; and (b) means for rotating said disks, and third conduit means for extracting pulpous slurry with impurities of a size larger than the selected size collect from said chamber, whereby rotation of the disks causes impurities larger than the selected size to be projected outward upon contact with the rotating disks while permitting pulp fibers smaller that the selected size to be drawn through the entrance channel, through the conveyance channel and into the second conduit means thereby separating the impurities from the pulpous fibers.

2. The apparatus of claim 1 wherein said first conduit means includes a passage extending through said chamber at an oblique angle with respect to an axis extending through said axially aligned, rotatable disks.

3. The apparatus of claim 1 wherein said first conduit means introduces said stream into a lower portion of said chamber so as to cause the stream to flow axially about said disks in one direction, and said apparatus further comprises forth conduit means for introducing a second stream of the slurry into an upper portion of said chamber so as to cause the second stream to flow axially about said disks in a direction generally opposite to said one direction.

4. The apparatus of claim 1 further comprising an auxiliary chamber coupled to said third conduit means having generally annular side walls about an upright central axis, auxiliary conduit means for extracting the pulpous slurry from said separation chamber and conveying the pulpous slurry to said auxiliary chamber, and said apparatus further comprises return conduit means for extracting the pulpous slurry from a central portion of said auxiliary chamber located between said upper and lower portions of said auxiliary chamber where pulpous fibers collect, and reject conduit means for extracting the pulpous slurry from a peripheral portion of said auxiliary chamber located between said upper and lower portions of said auxiliary chamber where impurities collect.

5. The apparatus of claim 4 wherein said auxiliary conduit means introduces a first stream of the slurry from said separation chamber into a lower portion of said auxiliary chamber so as to cause the first stream to flow about said chamber axis in one direction and said auxiliary conduit means introduces a second stream of the slurry from said separation chamber into an upper portion of said auxiliary chamber so as to cause the second stream to flow about said auxiliary chamber axis in a direction generally opposite to said one direction.

6. The apparatus of claim 4 wherein said return conduit means is coupled to said first conduit means to return pulp fibers to said separation chamber.

7. The apparatus of claim 4 wherein said return conduit means is coupled to said forth conduit means to return pulp fibers to said separation chamber.

8. The apparatus of claim 1 wherein said drawing means comprises at least one foil mounted between said rotatable disks.

9. The apparatus of claim 1 further comprising a screen mounted within said separation chamber for extracting impurities from said pulpous slurry prior to contact with said disks.

10. The apparatus of claim 1 wherein said disks taper inwardly toward a central portion of said disk to form said space with a configuration which narrows toward said central portion of said disk.

11. The apparatus of claim 1 wherein said disks are configured to converge toward said disk passage.

12. Apparatus for extracting impurities in excess of a selected size from pulp fibers of a pulpous slurry, comprising, a separation chamber having walls;

first conduit means for introducing a stream of pulpous slurry into said separation chamber;

at least two rotatable disks mounted coaxially within said separation chamber, said disks having a space therebetween sized smaller than the selected size, and at least one of said disks having second conduit means therethrough extending to and in fluid communication with said space between said disks for conveying pulp fibers within said space from said separation chamber by passing the pulp fibers through the space and into the second conduit means;

means for drawing the pulpous slurry into said space;

means for rotating said disks, and third conduit means for extracting pulpous slurry from a lower portion of said chamber where impurities collect as they settle within the chamber adjacent said chamber walls, whereby rotation of the disks causes impurities larger than said selected size to be projected outward upon contact with the rotating disks while permitting pulp fibers smaller that the selected size to be drawn through the space between the disks and into the second conduit means thereby separating the impurities from the pulpous fibers.

13. The apparatus of claim 12 wherein said first conduit means includes a passage extending through said chamber at an oblique angle with respect to an axis extending through said axially aligned, rotatable disks.

14. The apparatus of claim 12 wherein said first conduit means introduces said stream into a lower portion of said chamber so as to cause the stream to flow axially about said disks in one direction, and said apparatus further comprises forth conduit means for introducing a second stream of the slurry into an upper portion of said chamber so as to cause the second stream to flow axially about said disks in a direction generally opposite to said one direction.

15. The apparatus of claim 12 further comprising an auxiliary chamber coupled to said third conduit means having generally annular side walls about an upright central axis, auxiliary conduit means for extracting the pulpous slurry from said separation chamber and conveying the pulpous slurry to said auxiliary chamber, and said apparatus further comprises return conduit means for extracting the pulpous slurry from a central portion of said auxiliary chamber located between said upper and lower portions of said auxiliary chamber where pulpous fibers collect, and reject conduit means for extracting the pulpous slurry from a peripheral portion of said auxiliary chamber located between said upper and lower portions of said auxiliary chamber where impurities collect.

16. The apparatus of claim 15 wherein said auxiliary conduit means introduces a first stream of the slurry from said separation chamber into a lower portion of said auxiliary chamber so as to cause the first stream to flow about said chamber axis in one direction and said auxiliary conduit means introduces a second stream of the slurry from said separation chamber into an upper portion of said auxiliary chamber so as to cause the second stream to flow about said auxiliary chamber axis in a direction generally opposite to said one direction.

17. The apparatus of claim 15 wherein said return conduit means is coupled to said first conduit means to return pulp fibers to said separation chamber.

18. The apparatus of claim 15 wherein said return conduit means is coupled to said forth conduit means to return pulp fibers to said separation chamber.

19. The apparatus of claim 12 wherein said drawing means comprises at least one foil mounted between said rotatable disks.

20. The apparatus of claim 12 further comprising a screen mounted within said separation chamber for extracting impurities from said pulpous slurry prior to contact with said disks.

21. The apparatus of claim 12 wherein said disks taper inwardly toward a central portion of said disk to form said space with a configuration which narrows toward said central portion of said disk.

22. The apparatus of claim 12 wherein said disks are configured to converge toward said second conduit.

* * * * *